US012247401B2

(12) United States Patent
Fee et al.

(10) Patent No.: US 12,247,401 B2
(45) Date of Patent: Mar. 11, 2025

(54) BALUSTER INSTALLATION SYSTEM AND METHOD

(71) Applicant: Artistic Southern, Inc., Alpharetta, GA (US)

(72) Inventors: Kyle Fee, Alpharetta, GA (US); Randy Scott, Alpharetta, GA (US)

(73) Assignee: Artistic Southern, Inc., Alpharetta, GA (US)

( * ) Notice: Subject to any disclaimer, the term of this patent is extended or adjusted under 35 U.S.C. 154(b) by 439 days.

(21) Appl. No.: 17/590,906

(22) Filed: Feb. 2, 2022

(65) Prior Publication Data

US 2022/0243476 A1 Aug. 4, 2022

Related U.S. Application Data

(60) Provisional application No. 63/145,682, filed on Feb. 4, 2021.

(51) Int. Cl.
*E04F 11/18* (2006.01)

(52) U.S. Cl.
CPC ... *E04F 11/1817* (2013.01); *E04F 2011/1821* (2013.01)

(58) Field of Classification Search
CPC ..... E04F 11/18; E04F 11/181; E04F 11/1817; E04F 11/1842; E04F 2011/1823; E04F 2011/1825; E04F 2011/1827
See application file for complete search history.

(56) References Cited

U.S. PATENT DOCUMENTS 4,272,061 A * 6/1981 Suckno ..... E04F 11/1834 256/22
4,533,121 A * 8/1985 Basey ..... E04F 11/1834 256/67
5,308,205 A * 5/1994 Lautenschlager ..... F16B 19/004 411/908
5,685,682 A * 11/1997 Glime ..... F16B 21/082 411/510
6,299,397 B1 * 10/2001 Mengel ..... F16B 12/2027 411/24
7,762,533 B2 * 7/2010 DeRogatis ..... E04F 11/181 256/22
8,083,214 B2 * 12/2011 DeRogatis ..... E04F 11/1853 256/22
9,637,932 B2 * 5/2017 Schneider ..... E04H 17/1417
10,060,136 B2 * 8/2018 Milanowski ..... E04F 11/1817
(Continued)

FOREIGN PATENT DOCUMENTS

EP 2003265 A2 * 12/2008 ..... E04F 11/1817

*Primary Examiner* — Jonathan P Masinick
(74) *Attorney, Agent, or Firm* — Womble Bond Dickinson (US) LLP

(57) ABSTRACT

A baluster installation system. The system can comprise a connector comprising a first section for engaging an end of a baluster and a second end for engaging a route in a handrail. The first section can comprise a first shaft and a plurality of first ribs extending from the first shaft, and the second section can include a second shaft and a plurality of second ribs extending from the second shaft. The first ribs can be adapted to engage a portion of the baluster when the first section is engaged with the end of the baluster, and the second ribs can be adapted to engage sidewalls of the route when the second section is engaged with the route.

19 Claims, 4 Drawing Sheets

(56) References Cited

U.S. PATENT DOCUMENTS

| | | | | |
|---|---|---|---|---|
| 11,608,850 | B2 * | 3/2023 | von Wilcke | F16B 12/24 |
| 11,828,068 | B2 * | 11/2023 | Kurtz | E04F 11/1834 |
| 2007/0138455 | A1 * | 6/2007 | Walker | E04F 11/1842 256/22 |
| 2009/0173926 | A1 * | 7/2009 | Timothy | E04F 11/181 256/65.02 |
| 2020/0284041 | A1 * | 9/2020 | Legault | F16B 7/0446 |
| 2021/0180328 | A1 * | 6/2021 | Lin | E04F 11/1817 |

* cited by examiner

BALUSTER INSTALLATION SYSTEM AND METHOD

CROSS-REFERENCE TO RELATED APPLICATIONS

This application claims the benefit of U.S. Provisional Patent Application No. 63/145,682 filed on Feb. 4, 2021.

INCORPORATION BY REFERENCE

The disclosure of U.S. Provisional Patent Application No. 63/145,682, which was filed on Feb. 4, 2021, is hereby incorporated by reference for all purposes as if presented herein in its entirety.

TECHNICAL FIELD

The present disclosure relates to methods and systems for connecting balusters to a handrail. More specifically, the present disclosure is directed to a connector for attaching a baluster to a handrail and a method of attaching a baluster to a handrail with a connector for handrails in level and rake configurations.

BACKGROUND OF THE DISCLOSURE

In some examples, handrails and balusters can help provide a physical barrier to the passage of children and pets under the handrails of open stairways and balconies and thus prevent dangerous falls. In addition to their utilitarian value, they also contribute to the aesthetics of the stairway or balcony. Handrail and baluster assemblies can be offered in a variety of decorative designs and can be manufactured from wood, solid metal bars, hollow metal tubes, and other suitable materials.

In one example, a staircase can be installed by installing treads and risers followed by newel posts and/or other supports as needed. Balusters can be installed on the treads such as by drilling bores or holes in the treads and the balusters can be at least partially received in the holes so that the balusters extend upwardly from the holes in the treads. Alternatively, or in addition, balusters can be installed in holes formed along a landing, a balcony, etc. In some examples, bores can be drilled in an underside of a handrail, which can be positioned over the top ends of the balusters so that the tops of the balusters are at least partially received in the bores in the handrail. In some examples, the ends of the handrail can be fastened to the posts and/or walls and/or other suitable support structures with adhesive/glue, fasteners (e.g., screws, nails, nuts and bolts, etc.) and/or other suitable features. As a result, the balusters can be held at their top and bottom ends, which can help prevent removal of the balusters without damaging them.

Subsequently, the balusters can be aligned (e.g., by rotating the balusters in the holes in the treads and handrail) and locked into place by securing the tops and/or bases of the balusters with adhesive/glue, fasteners (e.g., screws, nails, fine wire nails, etc.) and/or other suitable features where applicable.

In some examples, balusters (e.g., hollow or solid metal balusters and/or other suitable balusters) can be installed by drilling holes (e.g. ½-inch, ⅝-inch, etc.) into the top of the treads, so that the holes can receive an end (e.g., a pin end) of the metal baluster. For example, the pin end of the baluster can be cylindrical in shape with a diameter of ½-inch or ⅝-inch and a length of ¾-inch. The opposing end of the example metal baluster is not fitted with a pin and is not secured with nails. In some examples, a hole (e.g., having a diameter of ¾-inch or 15/16-inch and a depth of about 1-inch) is drilled into the lower face of the stair rail. The bases of the metal balusters are inserted into the holes in the tread or floor and can rest upright. The rail is then slowly lowered into place and the individual metal balusters are manually brought into a vertical position and into alignment with the hole in the underside of the rail. The handrail is then secured at its ends into the walls and/or newels and/or other supports. At this point the metal balusters are only partially secured in place. To further secure them, each metal baluster can be rotated into alignment and moved into its correct position and a spring clamp or wedge is used to hold it in place. Then a commercial adhesive or epoxy is prepared and injected into the hole in the handrail. The metal baluster is then held in place until the adhesive or epoxy has dried or cured. Decorative covers (e.g., shoes) can be set in place to cover and hide the base attachment point and/or the top attachment point of the metal baluster. These decorative shoes can be made from cast metal, can be painted or powder coated to match the baluster's finish, can have an open base that is either flat or angled, and can have a top that narrows to an opening that matches the size and shape of the baluster shafts. The shoes can be fitted with mechanical fasteners, such as set screws, to secure them in place over the shafts of the balusters. These shoes are commercially available from sellers of stair parts such as Home Depot, Lowes and others.

Such example handrail installation processes include onsite drilling and measuring, wherein inaccuracies in drilling of the underside of the handrail can result in the metal balusters being irregularly spaced and/or nonparallel, such as if the holes in the underside of the handrail are not aligned with the holes in the treads or flooring, for example. For a handrail extending along the rake of the stair, holes are drilled at an angle in the bottom of the handrail after performing additional calculations and measuring for appropriate hole placement along handrail. Shortcomings of such handrail installation processes include that inaccuracies in the measurements and drilling can cause the balusters to be installed out of plum and can cause a loss of integrity to the balustrade.

Another disadvantage includes that the example metal balusters have a pin end and a square end, wherein the pin end nests into a hole in the tread while an oversized hole (e.g., having a diameter of ¾-inch to 15/16-inch) is drilled into the underside of the handrail for the square end. Additionally, this installation process includes the use of adhesives/epoxy and additional clamps and/or wedges and leaves unsightly features that are covered by decorative shoes. However, such decorative shoes may not be a desired aesthetic and may also damage metal balusters during installation. Further, matching the decorative shoes to the finish of the metal balusters can be difficult, causing some options to not be available or at an added cost to the system. In addition, the oversized hole in the underside of the handrail can lead to an increased amount of adhesive/epoxy used to fill the void and could cause improper bonding and the potential for loose balusters if not cured fully. Also, the oversized hole may not constrain a baluster well enough to allow for installation without the use of additional clamps or wedges when positioning the baluster in the top rail.

SUMMARY OF THE DISCLOSURE

In general, one aspect of the disclosure is directed to a baluster installation system. The system can comprise a connector comprising a first section for being at least partially received in an end of a baluster and a second end for being at least partially received in a route in a handrail. The first section can comprise a first shaft and a plurality of first ribs extending from the first shaft, and the second section can include a second shaft and a plurality of second ribs extending from the second shaft. The plurality of first ribs can be adapted to engage a portion of the baluster when the first section is at least partially received in the end of the baluster, and the plurality of second ribs can be adapted to engage sidewalls of the route when the second section is at least partially received in the route.

In another aspect, the disclosure is generally directed to a method of attaching a baluster to a handrail. The method can comprise obtaining a connector comprising a first section with a first shaft and a plurality of first ribs extending from the first shaft and a second section with a second shaft and a plurality of second ribs extending from the second shaft. The method further can comprise engaging the first section of the connector with an end of a baluster and engaging the second section of the connector with a route formed in a handrail.

In another aspect, the disclosure is generally directed to a handrail and baluster assembly. The assembly can comprise a handrail defining a route, a baluster having an end extending at least partially around an interior of the baluster, and a connector. The connector can comprise a first section at least partially received in the interior at the end of the baluster and a second section at least partially received in the route in the handrail. The first section can comprise a first shaft and a plurality of first ribs extending from the first shaft, and the plurality of first ribs can engage a portion of the baluster in the interior of the baluster for at least partially retaining the first section in the interior of the end of the baluster. The second section can comprise a second shaft and a plurality of second ribs extending from the second shaft, and the plurality of second ribs can engage sidewalls of the route for at least partially retaining the second section in the route.

Additional aspects, features, and advantages of the present invention will become apparent from the following description and accompanying figures.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of connecting balusters to a handrail. In embodiments, the disclosure includes a rail connector that connects (e.g., universally connects) a baluster (e.g., a hollow metal baluster or another suitable baluster) and a rail (e.g., a handrail for a stairway). In some embodiments, the rail connector can facilitate the installation of an angled rail system, such as those associated with stairs or ramps, a rail system having no angle, such as horizontal rails along balconies, stair landings, etc., and/or other suitable rail assemblies. The rail connector can be adaptable to be used with numerous different rail systems and angles.

Figure 6:
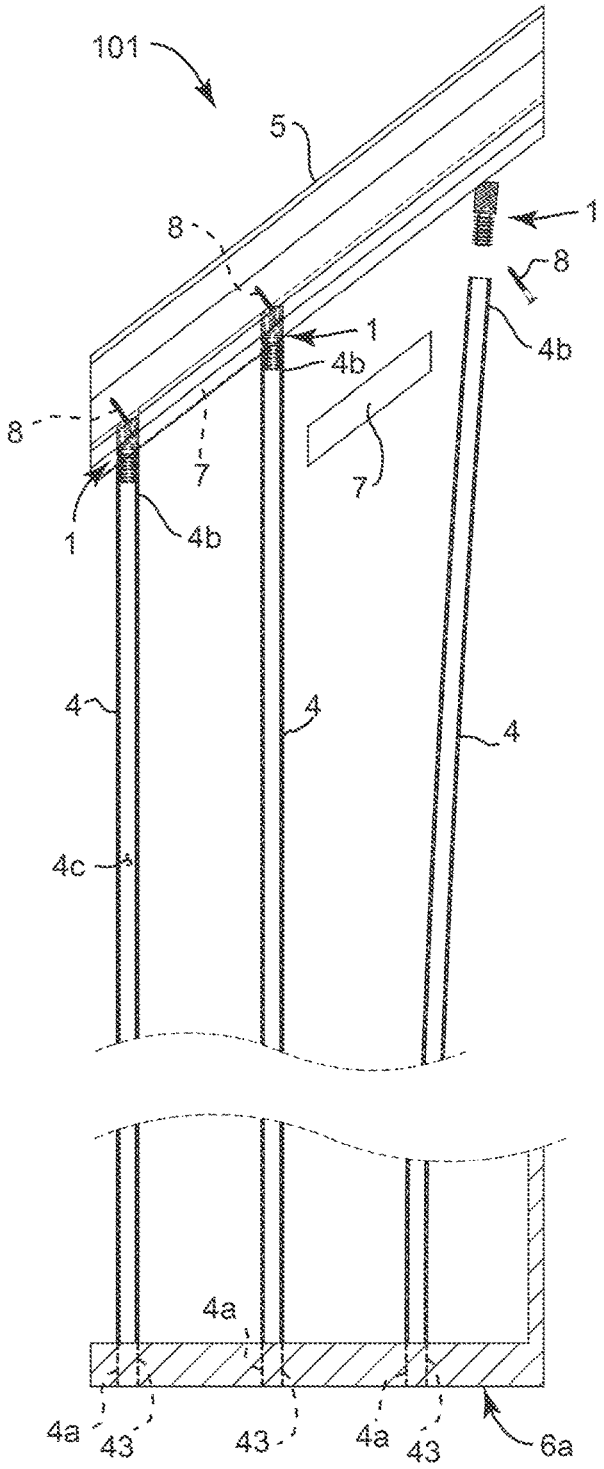
FIG. 6 is an elevation view of the baluster and handrail assembly of FIG. 3 showing the assembly of a baluster to the handrail in an angled configuration with the rail connector of FIG. 1.
Figure 7:
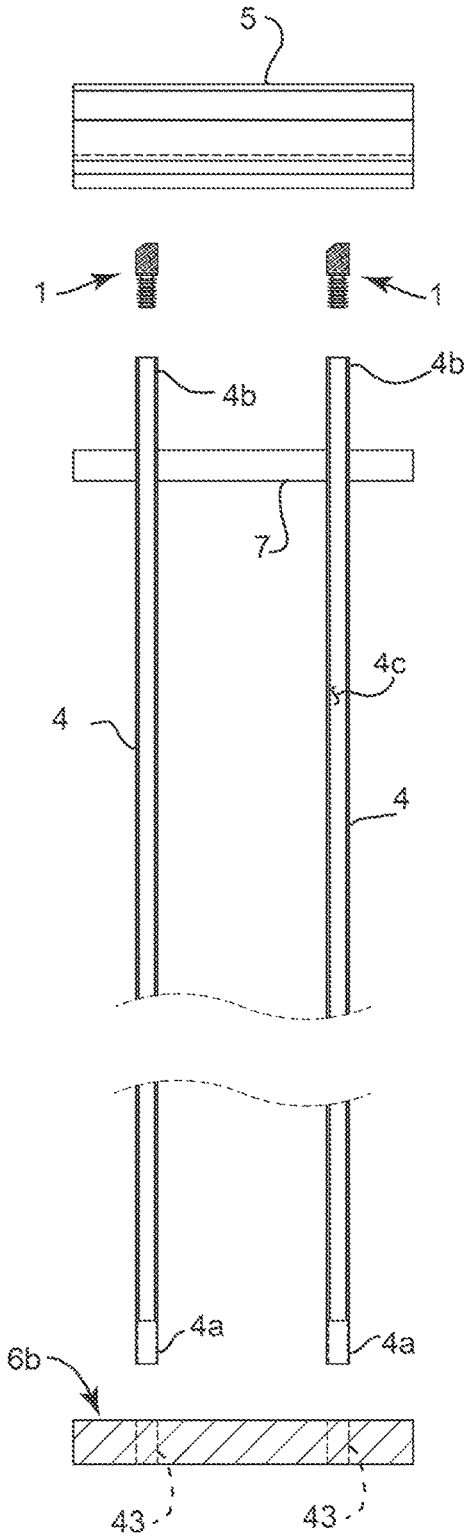
FIG. 7 is an exploded elevation view of the baluster and handrail assembly of FIG. 3 with the handrail in a horizontal configuration.

FIGS. 1-7 illustrate an example embodiment of a connector 1 for connecting a baluster 4 to a rail 5 to form a rail and baluster assembly 101 (FIGS. 3-6) including the connector 1, and a method of forming the rail and baluster assembly 101 with the connector 1 in accordance with the disclosure. In one embodiment, the rail and baluster assembly 101 can include a handrail 5 and one or more balusters 4 mounted to the handrail 5 by the connector 1 (FIGS. 3-7). In an exemplary embodiment, the rail 5 can be mounted between two support structures (e.g., newel posts, walls, etc.) (not shown) at an angle, extending along the rake of a set of stairs (FIGS. 3-6), and/or level, extending horizontally along a floor (e.g., of a stair landing, a balcony, etc.) (FIG. 7). In the illustrated embodiment, the rail 5 can be plowed/routed to form a plow or route 21 along its bottom, and the route 21 can include two sidewalls 23 (e.g., extending vertically along an interior of the route 21) and a transverse face 25 (FIGS. 3-7). In an exemplary embodiment, the route 21 can have a width of approximately ½-inch and a depth of approximately ¾-inch or could have any suitable dimensions. The rail 5 could be otherwise shaped, positioned, arranged, and/or configured without departing from the disclosure.

As shown in FIGS. 3-7, the baluster 4 can have a first or bottom end 4*a* (e.g., a rounded or pin end) and a second or top end 4*b*. In the illustrated embodiment, the bottom end 4*a* can be a rounded or pin end (e.g., a cylinder or any suitable shape) and the top end 4*b* can be a square end (e.g., with a generally square cross-section or any suitable cross-sectional shape). At least the top end 4*b* of the baluster 4 can be in the form of a tube (e.g., hollow) for at least partially receiving at least a portion of the connector 1 in the interior 4*c* of the baluster 4. In an exemplary embodiment, the entire length of the baluster 4 can be hollow. The baluster 4 could be otherwise shaped, positioned, arranged, and/or configured without departing from the disclosure.

Figure 1:
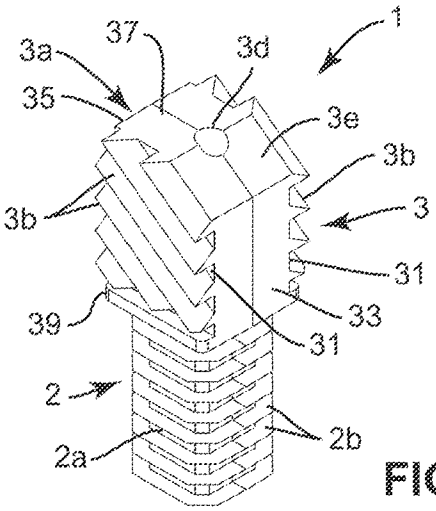
FIG. 1 is a perspective view of a rail connector for attaching a baluster to a handrail according to an exemplary embodiment of the disclosure.
Figure 2D:
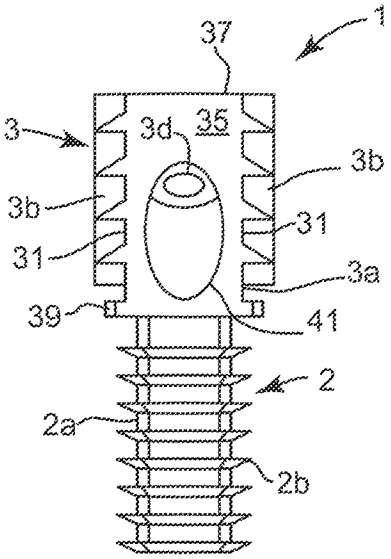
FIGS. 2B-2D are elevation views of the rail connector of FIG. 1.

As shown in FIGS. 1-2D, the connector 1 can include a first or lower section 2 and a second or upper section 3. In the illustrated embodiment, the lower section 2 can include a lower shaft 2*a*, which can have an octagonal cross-section or could have any suitable cross-sectional shape (e.g., a circle, an oval, a polygon, etc.). In exemplary embodiments, the shape of the lower shaft 2*a* can at least partially correspond to the cross-sectional shape of the interior 4*c* of the baluster 4. As shown in FIGS. 1 and 2B-2C, the lower shaft 2*a* can include a plurality of wrapped ribs 2*b* (e.g., interference fit ribs) extending around the perimeter of the lower shaft 2*a* and spaced along the height of the lower section 2. In the illustrated embodiment, the ribs 2*b* can be evenly spaced along the lower shaft 2*a*, and each can have a triangular cross-section with a base that extends radially outwardly (e.g., horizontally) from the lower shaft 2*a* to an outer edge of the rib 2*b* and a sloped surface extending downwardly and inwardly in an oblique direction from the outer edge to the lower shaft 2*a* (e.g., the sloped surface extends inwardly and away from the upper section 3 as it extends from the outer edge of the rib 2*b* to the lower shaft 2*a*). In an exemplary embodiment, the ribs 2*b* can act as teeth gripping the inside wall of the baluster 4 by flexing the ribs 2*b* in their range of motion when inserting the lower section 2 of the connector 1 into the top end 4*b* of the baluster 4. The ribs 2*b* can become compressed in the interior of the baluster 4 by the walls of the baluster when the lower section 2 of the connector 1 is inserted into the top end 4*b* of the baluster 4. The compression of the ribs 2*b* and/or frictional engagement of the ribs 2*b* with the interior of the baluster 4 can help resist removal of the connector 1 from the top end 4*b* of the baluster 4, opposing forces that may otherwise move the lower section 2 outwardly from the interior of the baluster 4. In the illustrated embodiment, the ribs 2*b* can help create a tight and secure fit to the inside walls of the baluster 4. Any portion of the lower section 2, including at least the lower shaft 2*a* and/or any of the ribs 2*b*, could be omitted or could be otherwise shaped, positioned, arranged, and/or configured without departing from the disclosure. For example, the ribs 2*b* could be unevenly spaced and/or could have any suitable cross-sectional shape.

As shown in FIGS. 1-2D, the upper section 3 of the connector 1 can include a second or upper shaft 3*a*, which can have a rectangular shape or any suitable shape. In the illustrated embodiment, oblique ribs 3*b* (e.g., interference fit ribs) can extend outwardly from the upper shaft 3*a*, can be evenly spaced along the upper shaft 3*a*, and can have a triangular cross-section or any suitable cross-sectional shape. In one embodiment, the oblique ribs 3*b* can be at an inverse and oblique orientation with respect to the lower shaft ribs 2*b* and/or with respect to a central axis of the connector 1 (e.g., a central axis of the upper shaft 3*a*). As shown in FIGS. 1-2D, the upper shaft 3*a* can include two sides 31 (e.g., a first side 31 and a second side 31), a front face 33, a rear face 35, and a top face 37. In the illustrated embodiment, the oblique ribs 3*b* can extend from the sides 31 between the front face 33 and the rear face 35 or the top face 37. In embodiments, each of the oblique ribs 3*b* can have a base extending outwardly (e.g., perpendicularly to) the respective side 31 to an outer edge and a sloped surface extending inwardly and upwardly (e.g., away from the lower shaft 2*a*) to the respective side 31. In the illustrated embodiment, the oblique ribs 3*b* can be arranged so that the outer edges and the bases extend along a downward slope from the rear face 35 to the front face 33.

Figure 2C:
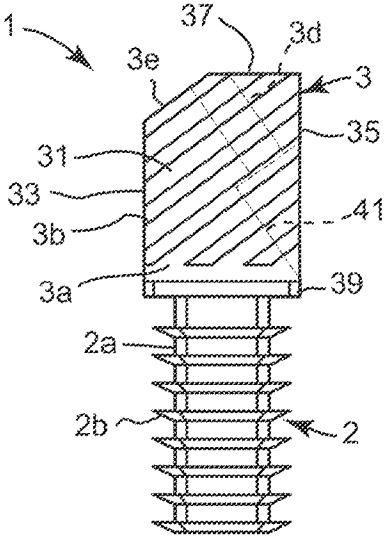
Figure 2A:
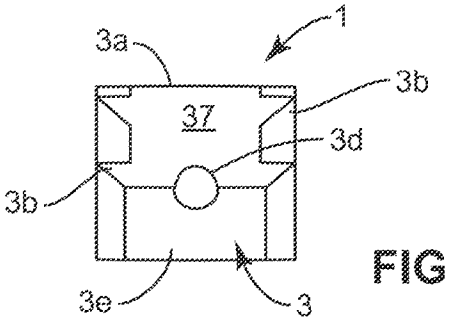
FIG. 2A is a top plan view of the rail connector of FIG. 1.
Figure 2B:
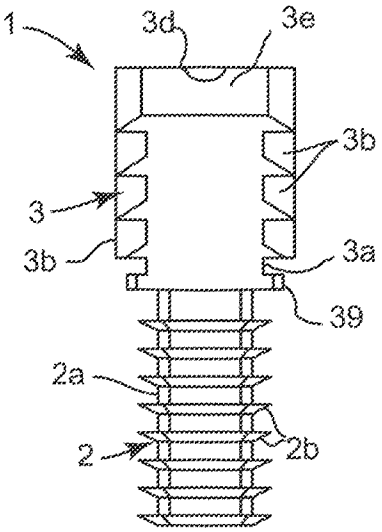
Figure 3:
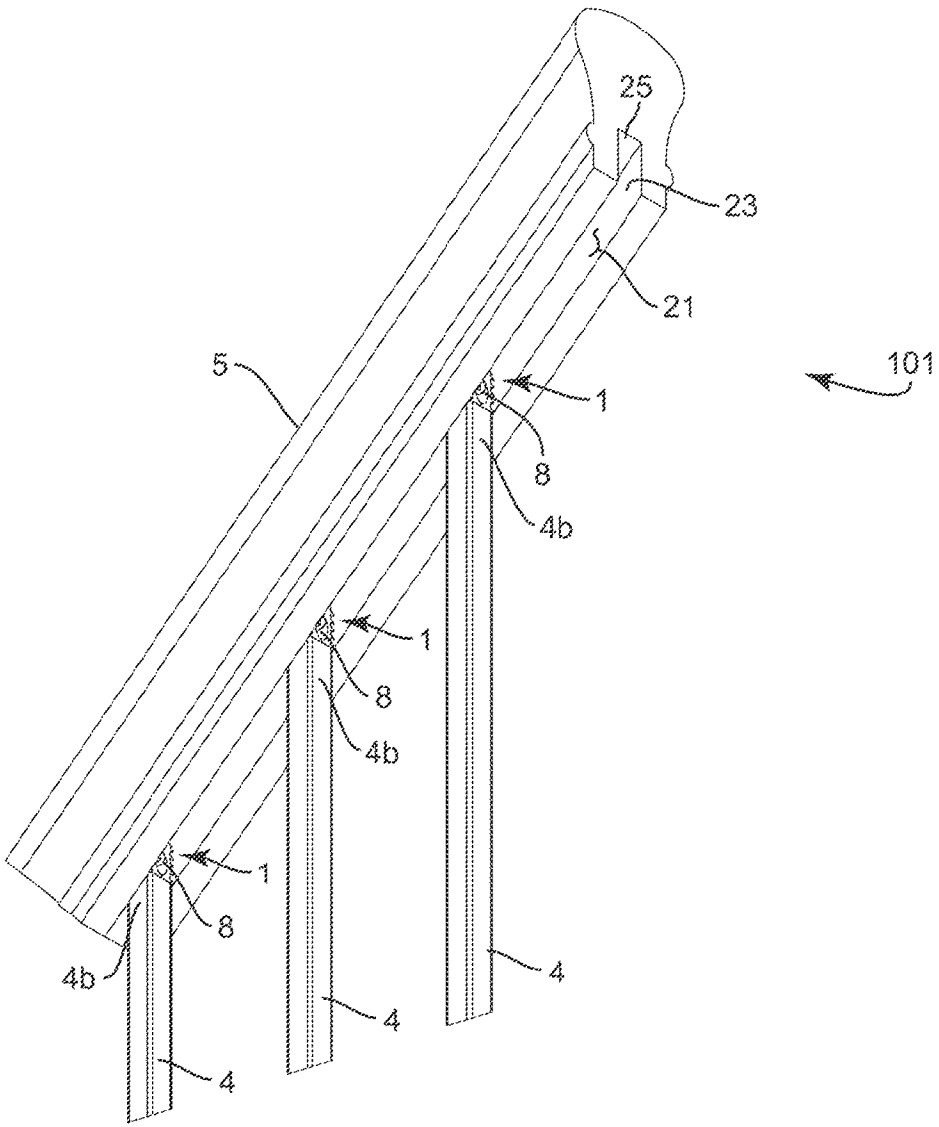
FIG. 3 is a perspective view of a baluster and handrail assembly according to an exemplary embodiment of the disclosure including the rail connector of FIG. 1.
Figure 5:
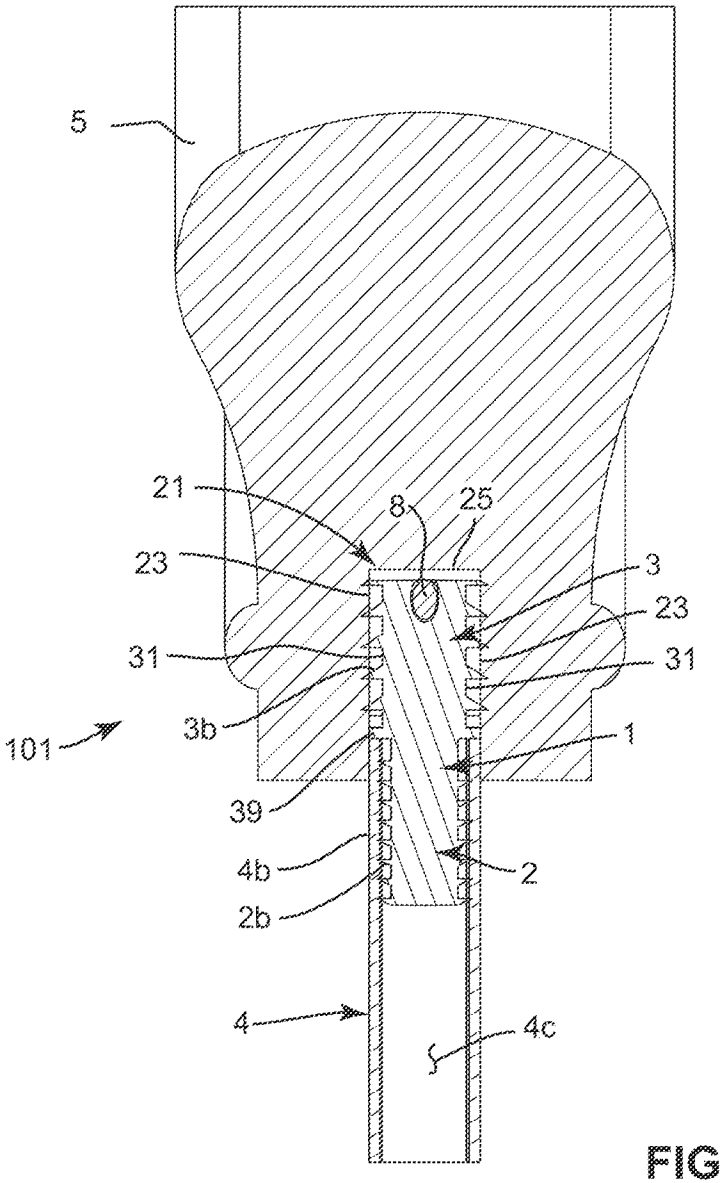
FIGS. 4 and 5 are cross-sectional views of the baluster and handrail assembly of FIG. 3.

In the illustrated embodiment, an oblique face 3*e* (e.g., an angled notch) can extend from the front face 33 to the top face 37 along the same or a similar angle as the oblique ribs 3*b*. For example, the angle of the oblique ribs 3*b* and the oblique face 3*e* can be approximately the average rake angle for a rail standard along a stair (e.g., an approximately 7⅜ slope). Alternatively, the oblique ribs 3*b* and/or the oblique face 3*e* can extend at any suitable angle for engaging a rail oriented at any suitable angle and/or the oblique ribs 3*b* and the oblique face 3*e* can extend at different angles. In the illustrated embodiment, the oblique ribs 3*b* can be angled to engage the sidewalls 23 of the route 21 so that the oblique ribs 3*b* are compressed and/or deformed when inserting the upper section 3 of the connector 1 into the route 21 (e.g., while rotating the baluster 4 into position along a stair) so that the ribs 3*b* resist motion away from the rail 5, at least partially locking the baluster 4 into position. As shown in FIGS. 1-2C, the oblique face 3*e* can be an additional guide for rotating the baluster 4 in position along a stair by engaging the transverse face 25 of the route 21 of the angled rail 5 (FIG. 4) and helping to stop the baluster 4 from over rotating past vertical. Further, the top face 37 of the upper shaft 3*a* can engage (e.g., contact, abut, etc.) the transverse face 25 of the route 21 for a horizontal rail 5 (FIG. 7) to help position the baluster 4 during installation so that the connector 1 can be used for rake and level applications. In exemplary embodiments, the oblique face 3*e* can help maximize the number of oblique ribs 3*b* positioned along the sides 31 of the upper shaft 3*a*.

As shown in FIGS. 1-2D, a counterbored hole 3*d* can extend from the rear face 35 to the top face 37 and the oblique face 3*e* (e.g., the hole 3*d* can be oriented perpendicularly to the oblique face 3*e*). In the illustrated embodiment, the hole 3*d* can be adapted to receive a fastener 8 (FIGS. 3-6) (e.g., a wood screw or other suitable fastener), to further fasten the baluster 4 to the underside of the rail 5. While one hole 3*d* is shown in the upper shaft 3*a*, the connector 1 could include any suitable number of holes 3*d* for use with any suitable number of fasteners 8 or the hole 3*d* and/or the fastener(s) 8 could be omitted. An opening or countersink 41 can be formed in the rear face 35 in communication with the hole 3*d* for accommodating the head of the fastener within the upper shaft 3*a*. In exemplary embodiments, the mechanical attachment feature of the connector 1 can help accommodate or limit any bow that may exist in a section of the rail 5.

As shown in FIGS. 1 and 2B-2D, a baluster cap stop 39 (e.g., which can be a square shaft or can have any suitable shape) can act as a shoulder or ledge extending outwardly from the upper shaft 3*a* for maintaining the depth of the connector 1 into the top end 4*b* of the baluster 4 (e.g., so that the connector 1 is not inserted too far into the baluster 4). Regardless of the quality of the finish cut of the baluster 4, the cap stop 39 and the lower section 2 can help keep the connector 1 centered in the baluster 4 and seated at the highest cut point of the top end 4*b* of the baluster 4. In the illustrated embodiment, the connector 1, nested and clamped inside of the baluster 4 with several rows of the ribs 2*b* engaging the inside wall of the baluster 4, can accommodate variations in the manufacturing of the baluster 4 (e.g., if the baluster finish cut is short, not straight, uneven, etc.) such as by adjusting how the connector 1 engages the top end 4*b* of the baluster 4 (e.g., by not fully seating into the baluster 4). In exemplary embodiments, the route 21 can at least partially conceal any imperfections in the top end 4*b* of the baluster 4 when the upper section 3 is received in the route 21, as described in more detail below, so that the addition of decorative shoes are not needed to hide the imperfections or variations in fit. Any portion of the upper section 3, including at least the upper shaft 3*a* any of the oblique ribs 3*b*, the hole 3*d*, the countersink 41, the oblique face 3*e*, the faces 31, 33, 35, 37, and/or the stop cap 39, could be omitted or could be otherwise shaped, positioned, arranged, and/or configured without departing from the disclosure. For example, the ribs 3*c* could be unevenly spaced.

Referring now to FIG. 6, the rail connector 1 is shown with a baluster 4, a plowed rail 5, and tread 6*a* of a stair. As shown in FIG. 6, the rail 5 is positioned at an angle, along the rake of the stairs, and the rail 5 can be mounted to a support, such as a newel post or wall, at each end. In the illustrated embodiment, the lower section 2 of the connector 1 is inserted into the top end 4*b* of the baluster 4 so that the ribs 2*b* become deformed and compressed by the inner walls of the baluster 4 in its interior 4*c* to help maintain the engagement between the connector 1 and the top end 4*b* of the baluster 4 and resist removal of the lower section 2 of the connector from the interior 4*c*. The connector 1 can be pressed into the top end 4*c* until the cap stop 39 engages the top end 4*b* and resists further insertion of the connector 1 into the top end 4*b*.

As shown in FIG. 6, the treads 6*a* of the stair can be drilled with one or more holes 43 (e.g., having a diameter of 7/16-inch or any suitable diameter) for receiving the pin end 4*a* of respective balusters 4. For example, each tread 6*a* can include three holes. In the illustrated embodiment, the pin end 4*a* of the baluster 4 can be positioned into one of the holes 43 in the tread 6*a* with the connector 1 oriented so that the front face 33 and the oblique face 3*e* are directed toward the rail 5. Subsequently, the baluster 4 can be pivoted to a vertical orientation while pressing the upper section 3 of the connector 1 into the route 21 of the rail 5. When the upper section 3 is inserted into the route 21, the oblique face 3*e* can engage the transverse face 25 of the route 21 to stop further pivoting of the baluster 1. As the upper section 3 is inserted into the route 21, the side faces 31 of the upper shaft 3*a* can be parallel to the sidewalls 23 of the route 21 so that the oblique ribs 3*b* are deformed and compressed by the sidewalls 23. Accordingly, the engagement of the oblique ribs 3*b* and the sidewalls 23 can help resist removal of the upper section 3 of the connector 1 from the route 21 and can help maintain the connection of the baluster 4 with the rail 5 via the connector 1. In one embodiment, the interference fit between the oblique ribs 3*b* and the sidewalls 23 can help retain the oblique face 3*e* in engagement with the transverse face 25. In some embodiments, the connector 1 can be further secured to the rail 5 by inserting the fastener 8 into the hole 3*d* via the countersink 41 and screwing the fastener 8 into the rail 5 via the transverse face 25 of the route 21 (FIGS. 3-6). In an example embodiment, a pilot hole can be drilled into the rail 5 before screwing the fastener 8 into place. In other embodiments, the fastener 8 could be omitted or any suitable number of fasteners could be used. This process can be repeated to connect balusters 4 to the rail 5 with the connectors 1 along the entire stairway from the first open tread at the bottom to the last open tread or along any suitable portion of the rail 5.

Figure 4:
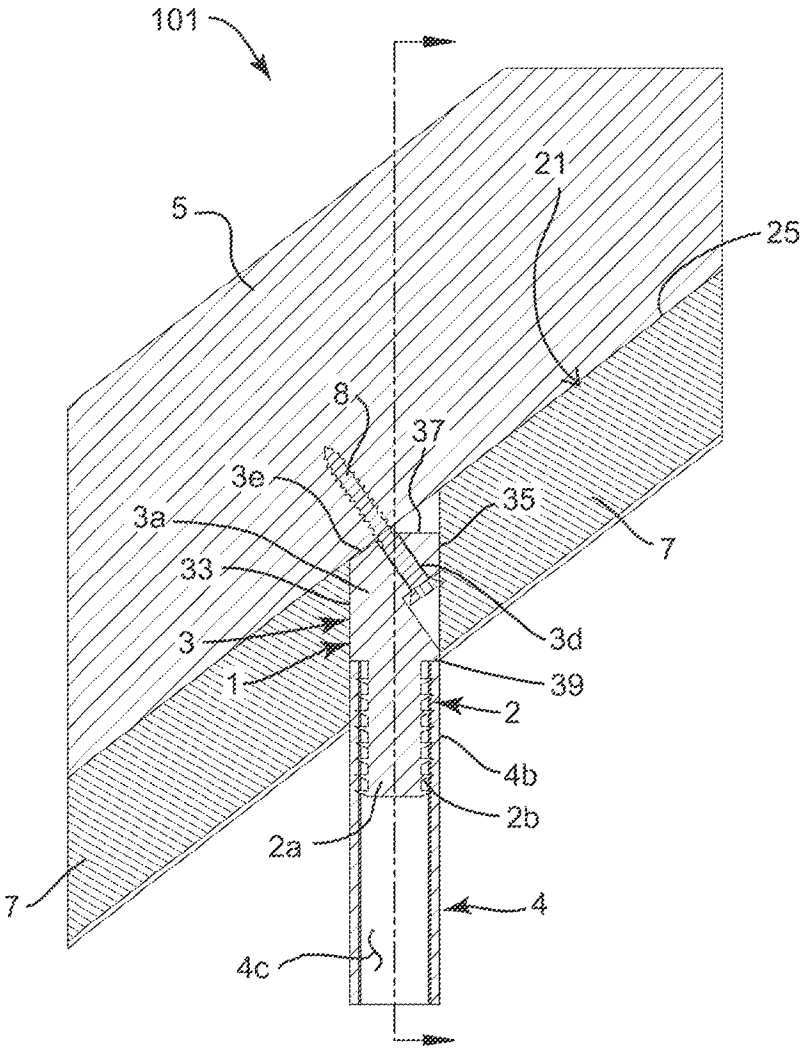

As shown in FIGS. 4 and 6, a fillet 7 can be inserted into the route 21 between each pair of connectors 1 along the length of the rail 5. In the illustrated embodiment, the ends of the fillet 7 can be oblique so that they are in a vertical orientation when the fillet 7 extends along the angle of the rail 5. Accordingly, the ends of the fillet 7 can engage the vertical rear face 35 of one connector 1 and the vertical front face 33 of the opposing connector 1. In an exemplary embodiment, the fillets 7 can be secured with one or more fasteners (e.g., a pin nail or other suitable fastener) through the underside of the fillet 7 and/or the side of the rail 5. Alternatively, or in addition, the fillets 7 can be secured with adhesive and/or other suitable features. In the illustrated embodiment, the fillet 7 can help retain the connectors 1 in position within the route 21 and can help conceal the connectors 1 and the route 21 on the underside of the rail 5.

In one exemplary embodiment, the balusters 4 and the rail 5 can be assembled with the connectors 1 along the rake of a stair by plowing the underside of the top rail 5 to form the plow 21 (e.g., being ½-inch wide by ¾-inch deep or any suitable dimensions); setting appropriate number of newels or other supports (not shown) along the stairway; spacing and drilling the base holes 43 (e.g., having a diameter of 7/16-inch or any suitable diameter) evenly along each tread 6*a* (e.g., 3 holes per tread); setting the top rail 5 in between newels or other supports; selecting pre-cut balusters 4 for each position along the rake of the stair; inserting the lower section 2 of the connector 1 into the square top end 4*b* of the respective balusters 4; inserting the rounded end 4*a* of each baluster 4 into the respective base holes 43 of the treads; pivoting the balusters 4 into the plow 21 of the rail 5 until balusters 4 are plumb; and inserting the fillet 7 in between the balusters 4 with a slight reveal along the bottom of the rail 5.

Referring now to FIG. 7, the rail connector 1 is shown with two balusters 4, the rail 5 in a horizontal orientation, and floor 6*b* having spaced holes 43. In the illustrated embodiment, the pin end 4*a* of the baluster 4 can be inserted into the holes 43, which can be evenly spaced or could be otherwise spaced on the floor 6*b*. The lower sections 2 of the connectors 1 can be inserted into the top ends 4*b* of the balusters 4 as described above and the rail 5 can be lowered on top of the baluster 4 and secured by the rail connectors 1 similarly as described above for the sloped rail 5. In one embodiment, the top face 37 of the upper shaft 3*a* of the connector 1 can engage the traverse face 25 of the route 21 when the rail 5 is in position. In some embodiments, the fastener 8 can be installed as described above or could be omitted. Subsequently, the fillets 7 (e.g., have vertical ends) can be inserted between balusters 4 and secured with a pin nail or other suitable fastener through the underside of the fillet 7 and/or the side of the rail 5. Alternatively, or in addition, the fillets 7 can be secured with adhesive and/or other suitable features.

In one exemplary embodiment, the balusters 4 and the rail 5 can be assembled with the connectors 1 in a level orientation of the rail 5 by plowing the underside of the top rail 5 to form the plow 21 (e.g., being ½-inch wide by ¾-inch deep or any suitable dimensions); setting appropriate number of newels or other supports (not shown) along the level rail 5; spacing and drilling the base holes 43 (e.g., having a diameter of 7/16-inch or any suitable diameter) evenly along the floor 6*b* (e.g., with a 4⅜" center to center spacing); selecting the precut balusters 4 and inserting the pin end 4*a* of each baluster 4 into the respective base holes 43 in the floor 6*b*; inserting the lower sections 2 of the connectors 1 in the respective top ends 4*b* of the respective balusters 4; positioning the rail 5 on top of the balusters 4 with the upper sections 3 of the connectors 1 at least partially received in the route 21; securing the rail 5 to the newels or other supports at a desired rail height; and inserting the fillets 7 between the balusters 4 with a slight reveal along the bottom of the rail 5.

The handrail and baluster assembly 101 could be otherwise formed from the connector 1, the baluster 4, and the rail 5 without departing from the disclosure.

In embodiments, the connector 1 of the present disclosure can facilitate easier and faster installation of a balustrade. In some embodiments, the assembly can be entirely mechanical and the connector 1 can reduce or eliminate the need for adhesive/glue or epoxy, which can be messy. Also, since at least the connector 1 is concealed in the route 21 of the handrail 5 and by the fillets 7, decorative shoes can be omitted if desired. In some embodiments, the rail 5 can be pre-prepared prior to onsite installation so that onsite measuring and drilling of the rail 5 can be avoided, while also allowing the opportunity to pre-finish the handrail 5 prior to installation.

In some embodiments, the route 21 in the rail 5 can allow the positioning of the balusters 4 at any point along the rail 5 so that the balusters 4 can be placed as needed without onsite drilling and measuring or with reduced onsite drilling and measuring. In addition, the route 21 of the rail 5 can provide two fixed faces 23 to which the connector 1 can wedge into. Further, the rail fillets 7 can be used to fill in between each baluster 4 once the balusters 4 are secured to the rail 5 (e.g., by the oblique ribs 3*b* and/or the fastener 8). In some embodiments, the rail fillets 7 can add a secondary constraint to the balusters 4, retaining the balusters 4 in the correct position while also filling the additional void in the bottom of the rail 5.

Any of the features of the various embodiments of the disclosure can be combined with, replaced by, or otherwise configured with other features of other embodiments of the disclosure without departing from the scope of this disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A baluster installation system comprising a connector, comprising:

a first section for being at least partially received in an end of a baluster, the first section comprising a first shaft and a plurality of first ribs extending from the first shaft, wherein the plurality of first ribs is adapted to engage a portion of the baluster when the first section is at least partially received in the end of the baluster; and a second section for being at least partially received in a route in a handrail, the second section comprising a second shaft and a plurality of second ribs extending from the second shaft, wherein the plurality of second ribs is adapted to engage sidewalls of the route when the second section is at least partially received in the route, and wherein the second shaft comprises at least a front face, a top face, and an oblique face extending between the top face and the front face, and each second rib of the plurality of second ribs is parallel to the oblique face.

2. The baluster installation system of claim 1, wherein each first rib of the plurality of first ribs comprises a wrapped rib extending around a perimeter of the first shaft, and the first ribs are spaced along a height of the first shaft.

3. The baluster installation system of claim 1, wherein each first rib of the plurality of first ribs comprises a base that extends radially outwardly from the first shaft.

4. The baluster installation system of claim 3, wherein each of the first ribs has a triangular cross-section with a sloped surface extending from the base to the first shaft and away from the second section.

5. The baluster installation system of claim 1, wherein the second shaft comprises at least a side extending between at least two faces of the second shaft, and second ribs of the plurality of second ribs are spaced along the side.

6. The baluster installation system of claim 1, wherein the second shaft comprises a first side and a second side, each extending from the front face to a rear face of the second shaft, and each second rib of the plurality of second ribs extends on one of the first side and the second side.

7. The baluster installation system of claim 1, wherein each second rib of the plurality of second ribs has a triangular cross-section and extends obliquely with respect to the plurality of first ribs.

8. The baluster installation system of claim 1, wherein the second shaft comprises a rear face opposite to the front face and defines a hole extending from the rear face to the top face and the oblique face, the hole extends perpendicular to the oblique face, and the hole is adapted to at least partially receive a fastener for at least partially securing the connector to the handrail.

9. A method of attaching a baluster to a handrail, the method comprising:

obtaining a connector comprising a first section with a first shaft and a plurality of first ribs extending from the first shaft and a second section with a second shaft and a plurality of second ribs extending from the second shaft, wherein the second shaft comprises at least a front face, a top face, and an oblique face extending between the top face and the front face, and each second rib of the plurality of second ribs is parallel to the oblique face;

engaging the first section of the connector with an end of a baluster; and engaging the second section of the connector with a route formed in a handrail.

10. The method of claim 9, wherein the plurality of first ribs is in frictional engagement with the end of the baluster after the engaging the first end of the connector with the end of the baluster, and the plurality of second ribs is in frictional engagement with sidewalls of the route of the handrail after the engaging the second section of the connector with the route.

11. The method of claim 9, wherein the handrail has a transverse face extending along the route, and the engaging the second section of the connector with the route comprises positioning the second section in the route so that the transverse face of the route abuts at least one of the top face and the oblique face of the second shaft.

12. The method of claim 9, further comprising positioning the handrail to extend along a rake of a stair, wherein the engaging the second section of the connector with the route comprises positioning the second shaft within the route so that the oblique face abuts a face of the handrail extending in the route along the rake of the stair.

13. The method of claim 9, further comprising securing the connector to the handrail by securing a fastener to the handrail via a hole defined in the second shaft and into a face of the handrail extending along the route.

14. The method of claim 9, further comprising inserting a fillet into the route proximate the connector after the engaging the second section of the connector with the route.

15. A handrail and baluster assembly, comprising:

a handrail defining a route;

a baluster having an end extending at least partially around an interior of the baluster; and a connector comprising:

a first section at least partially received in the interior at the end of the baluster, the first section comprising a first shaft and a plurality of first ribs extending from the first shaft, wherein the plurality of first ribs engages a portion of the baluster in the interior of the baluster for at least partially retaining the first section in the interior of the end of the baluster; and a second section at least partially received in the route in the handrail, the second section comprising a second shaft and a plurality of second ribs extending from the second shaft, wherein the plurality of second ribs engages sidewalls of the route for at least partially retaining the second section in the route, and wherein the second shaft comprises at least a front face, a top face, and an oblique face extending between the top face and the front face, and each second rib of the plurality of second ribs is parallel to the oblique face.

16. The handrail and baluster assembly of claim 15, wherein the plurality of first ribs is in frictional engagement with a wall of the baluster extending along the interior of the end of the baluster, and the plurality of second ribs is in frictional engagement with the sidewalls of the route of the handrail.

17. The handrail and baluster assembly of claim 15, wherein the handrail has a transverse face extending between the sidewalls of the route, and the transverse face of the route abuts at least one of the top face and the oblique face of the second shaft.

18. The handrail and baluster assembly of claim 15, wherein the oblique face engages a transverse face of the route of the handrail, and the oblique face of the second shaft and the transverse face of the route extend along a similar or identical angle as a rake of a stair.

19. The handrail and baluster assembly of claim 15, wherein the second shaft comprises a rear face, the top face extending from the rear face to the oblique face, and a hole extending at least partially perpendicularly with respect to the oblique face from the rear face to the top face and the oblique face, and the connector is at least partially secured to the handrail by a fastener at least partially received in the hole and extending into the handrail via the route.

* * * * *